US009670916B2

(12) United States Patent
Ueda

(10) Patent No.: US 9,670,916 B2
(45) **Date of Patent: *Jun. 6, 2017**

(54) COMPRESSOR AND VACUUM MACHINE

(71) Applicant: SHINANO KENSHI CO., LTD., Ueda-shi, Nagano (JP)

(72) Inventor: Kazuhiro Ueda, Nagano (JP)

(73) Assignee: SHINANO KENSHI CO., LTD., Veda (JP)

( * ) Notice: Subject to any disclaimer, the term of this patent is extended or adjusted under 35 U.S.C. 154(b) by 499 days.

This patent is subject to a terminal disclaimer.

(21) Appl. No.: 13/894,946

(22) Filed: May 15, 2013

(65) Prior Publication Data

US 2013/0343930 A1 Dec. 26, 2013

(30) Foreign Application Priority Data

Jun. 20, 2012 (JP) ..... 2012-138931

(51) Int. Cl.
*F04B 17/03* (2006.01)
*F04B 39/12* (2006.01)
(Continued)

(52) U.S. Cl.
CPC ..... *F04B 17/03* (2013.01); *F04B 35/01* (2013.01); *F04B 35/04* (2013.01); *F04B 37/04* (2013.01); *F04B 39/121* (2013.01)

(58) Field of Classification Search
CPC ..... F04B 27/00; F04B 27/02; F04B 27/04; F04B 27/0451; F04B 27/0465;
(Continued)

(56) References Cited

U.S. PATENT DOCUMENTS 2,263,989 A 9/1882 Sterne
1,654,893 A * 1/1928 Meyers ..... F04B 27/0409 417/273
(Continued)

FOREIGN PATENT DOCUMENTS

CN 2597707 Y 1/2004
CN 101605993 A 12/2009
(Continued)

OTHER PUBLICATIONS

Feb. 12, 2013 Office Action issued in Japanese Patent Application No. 2012-138931 (with translation).
(Continued)

*Primary Examiner* — Nathan Zollinger
(74) *Attorney, Agent, or Firm* — Oliff PLC

(57) ABSTRACT

A compressor including a motor, a piston reciprocating by the motor, a crankcase having a middle wall portion formed with a communication hole, the crankcase housing the piston, a cylinder body secured to an inner surface of the middle wall portion, the cylinder body and the wall portion defining a cylinder chamber, and reciprocation of the piston increasing or decreasing a capacity of the cylinder chamber, and a cylinder head secured to an outer surface of the middle wall portion, the cylinder head and the middle wall portion defining an exhaust chamber communicated with the cylinder chamber through the communication hole.

12 Claims, 4 Drawing Sheets

(51) Int. Cl.
*F04B 35/01* (2006.01)
*F04B 35/04* (2006.01)
*F04B 37/04* (2006.01)

(58) Field of Classification Search
CPC ..... F04B 27/0533; F04B 27/0428; F04B 27/0673; F04B 39/121; F04B 39/125; F04B 39/126; F04B 39/127; F04B 37/04; F04B 35/01; F04B 17/00; F04B 17/03; F04B 1/04; F04B 1/0404; F04B 27/0404; F04B 35/04; F16J 10/04; F01B 3/0029; F01B 31/28; F03C 1/0626; F03C 1/0628
USPC ..... 92/72; 417/273, 372, 410.1, 423.14
See application file for complete search history.

(56) References Cited

U.S. PATENT DOCUMENTS

| | | | | |
|---|---|---|---|---|
| 2,345,125 | A | 3/1944 | Huber | |
| 2,676,753 | A * | 4/1954 | Britton | F04B 27/0451 417/203 |
| 4,400,144 | A * | 8/1983 | Drutchas | F04B 39/06 417/415 |
| 6,175,354 | B1 * | 1/2001 | Blissett | F04D 29/38 345/110 |
| 7,959,415 | B2 | 6/2011 | Schuetzle et al. | |
| 8,435,013 | B2 * | 5/2013 | Kondou | B01D 53/047 417/269 |
| 2004/0070267 | A1 * | 4/2004 | Volz | B60T 8/368 188/157 |
| 2005/0069431 | A1 | 3/2005 | Leu | |
| 2010/0319547 | A1 * | 12/2010 | Kondou | B01D 53/047 96/143 |
| 2013/0189132 | A1 | 7/2013 | Okada et al. | |
| 2013/0251564 | A1 * | 9/2013 | Okada | F04B 35/06 417/420 |

FOREIGN PATENT DOCUMENTS

| | | | | |
|---|---|---|---|---|
| JP | A-58-176484 | | | 10/1983 |
| JP | S59-141778 | A | | 8/1984 |
| JP | A-2-230983 | | | 9/1990 |
| JP | A-7-151056 | | | 6/1995 |
| JP | H08-338369 | A | | 12/1996 |
| JP | 2000320458 | A | * | 11/2000 |
| JP | A-2000-320458 | | | 11/2000 |
| JP | A-2004-183498 | | | 7/2004 |
| JP | 2004-274907 | A | | 9/2004 |
| JP | 2004274907 | A | * | 9/2004 |
| JP | A-2004-316578 | | | 11/2004 |
| JP | 2008154369 | A | * | 7/2008 |
| JP | 2009-030462 | A | | 2/2009 |
| JP | A-2009-185789 | | | 8/2009 |
| JP | 4872938 | B2 | | 2/2012 |

OTHER PUBLICATIONS

Apr. 28, 2015 Office Action issued in Chinese Patent Application No. 201310238314.0.
Jun. 4, 2013 Office Action issued in Japanese Patent Application No. 2012-138931 (with translation).
Dec. 13, 2016 Office Action issued in Chinese Patent Application No. 201310238058.5.

* cited by examiner

COMPRESSOR AND VACUUM MACHINE

CROSS-REFERENCE TO RELATED APPLICATION

This application is based upon and claims the benefit of priority of the prior Japanese Patent Application No. 2012-138931, filed on Jun. 20, 2012, the entire contents of which are incorporated herein by reference.

BACKGROUND (i) Technical Field

The present invention relates to a compressor and a vacuum machine.

(ii) Related Art

There is known a compressor and a vacuum machine where a piston reciprocates within a cylinder by a motor. Japanese Patent Application Publication No. 2004-183498 discloses such a compressor. As for general compressor and vacuum machine, a cylinder body and a cylinder head are provided outside a crankcase.

In order to provide the cylinder body and the cylinder head outside the crankcase, the cylinder body is secured to a wall portion of the crankcase, and the cylinder head is secured to the cylinder body. In this case, a seating portion on which the piston is seated has to be provided separately from the wall portion of the crankcase. Therefore, the whole size of the device may increase in such a direction that the piston moves. Also, an exclusive part functioning as the seating portion is needed, so that the number of the parts increases.

On the other hand, in order to downsize the compressor and the vacuum machine, the cylinder or the crankcase is reduced in size. However, if the cylinder is reduced in size, absorption or discharging ability of the compressor and the vacuum machine might deteriorate. Also, if the crankcase is reduced in size, the cylinders interfere with each other. Thus, there is a limit in reducing the crankcase in size.

SUMMARY

According to an aspect of the present invention, there is provided a compressor including: a motor; a piston reciprocating by the motor; a crankcase comprising a wall portion formed with a communication hole, and the crankcase housing the piston; a cylinder body secured to an inner surface of the wall portion, the cylinder body and the wall portion defining a chamber, and reciprocation of the piston increasing or decreasing a capacity of the chamber; and a cylinder head secured to an outer surface of the wall portion, and the cylinder head and the wall portion defining space communicated with the chamber through the communication hole.

According to another aspect of the present invention, there is provided a vacuum machine including: a motor; a piston reciprocating by the motor; a crankcase comprising a wall portion formed with a communication hole, and the crankcase housing the piston; a cylinder body secured to an inner surface of the wall portion, the cylinder body and the wall portion defining a chamber, and reciprocation of the piston increasing or decreasing a capacity of the chamber; and a cylinder head secured to an outer surface of the wall portion, and the cylinder head and the wall portion defining space communicated with the chamber through the communication hole.

DETAILED DESCRIPTION

[First Embodiment]

Figure 1:
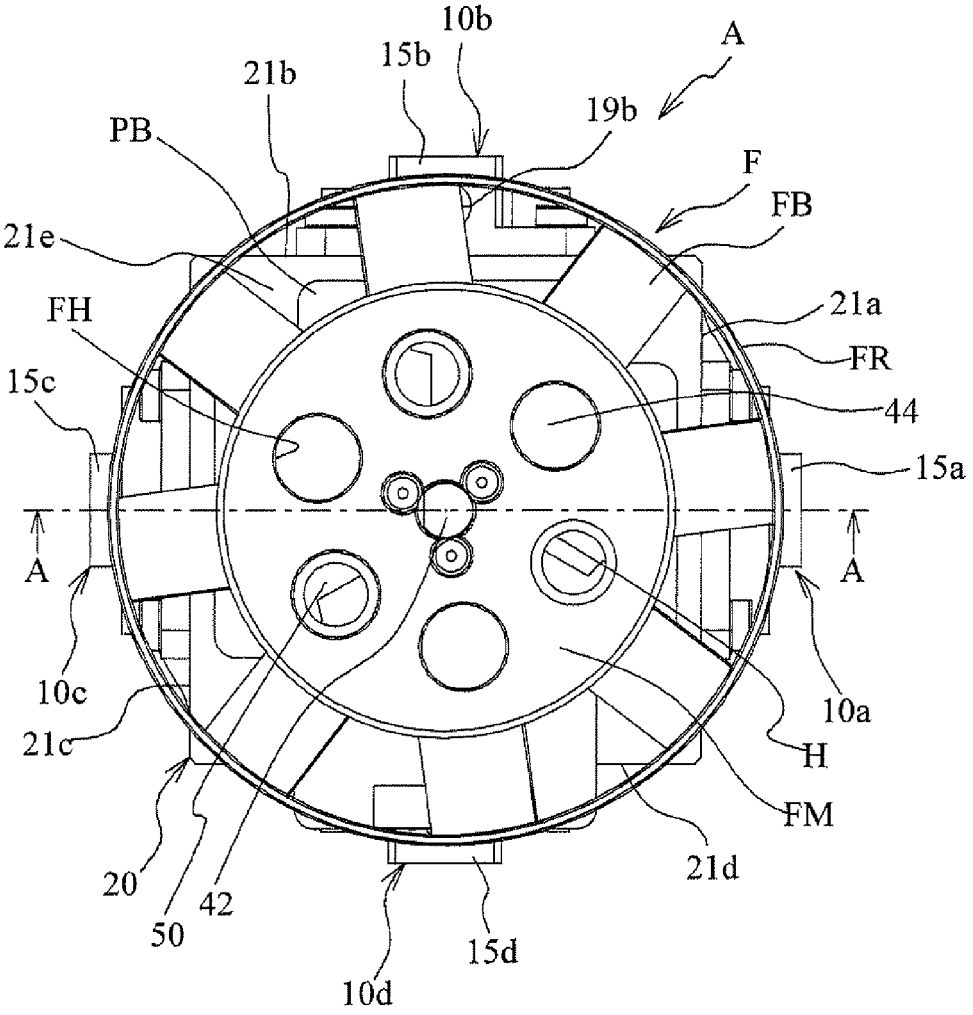
FIG. 1 is an external view of a compressor according to a first embodiment.
Figure 2:
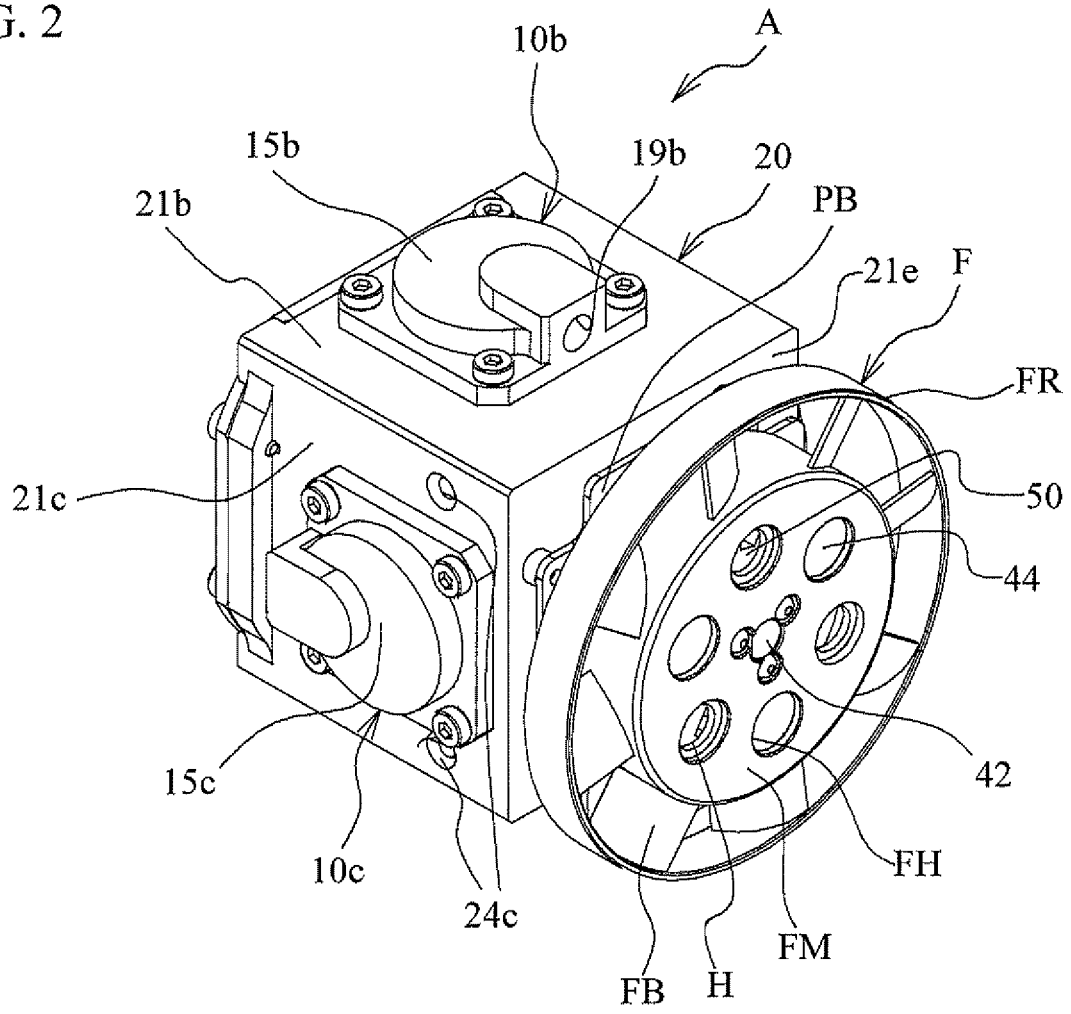
FIG. 2 is an external view of the compressor according to the first embodiment.

FIGS. 1 and 2 are external views of a compressor A according to a first embodiment. The compressor A includes: a crankcase 20; four cylinders 10*a* to 10*d* provided with the crankcase 20; and a fan F arranged at the upper side of the crankcase 20. The Fan F is secured to a motor. The motor will be described later in detail. The cylinder 10*a* includes a cylinder head 15*a* secured to the outside of the crankcase 20, and a cylinder body provided within the crankcase 20. Likewise, the other cylinders 10*b* to 10*d* have the same structure. Thus, the other cylinder heads 15*b* to 15*d* are provided on wall portions of the crankcase 20, respectively.

Specifically, the cylinder heads 15*a* to 15*d* are secured to the flat, outer surfaces of the middle wall portions of the crankcase 20, respectively. As illustrated in FIG. 1, the cylinder heads 15*a* to 15*d* are radially arranged about the rotational shaft 42 at even intervals. Middle wall portions 21*a* and 21*b* are adjacent and perpendicular to each other, and the middle wall portions 21*c* and 21*d* are adjacent and perpendicular to each other. The middle wall portions 21*a* and 21*c* face each other in the parallel manner, and the middle wall portions 21*b* and 21*d* face each other in the parallel manner. Also, the crankcase 20 is provided with an upper wall portion 21*e* near the motor. The cylinder heads, the cylinder bodies, the crankcase 20 are made of metal such as aluminum having good heat radiation characteristics.

The fan F, which is secured to the motor, includes: a body portion FM having a substantially cylindrical shape; a ring portion FR formed at the outside of the body portion FM; and plural blade portions FB formed between the body portion FM and the ring portion FR. Rotation of the motor causes pistons to reciprocate within the crankcase 20 and causes the fan F to rotate, as will be described later in detail. This can cool the whole compressor A.

Figure 3:
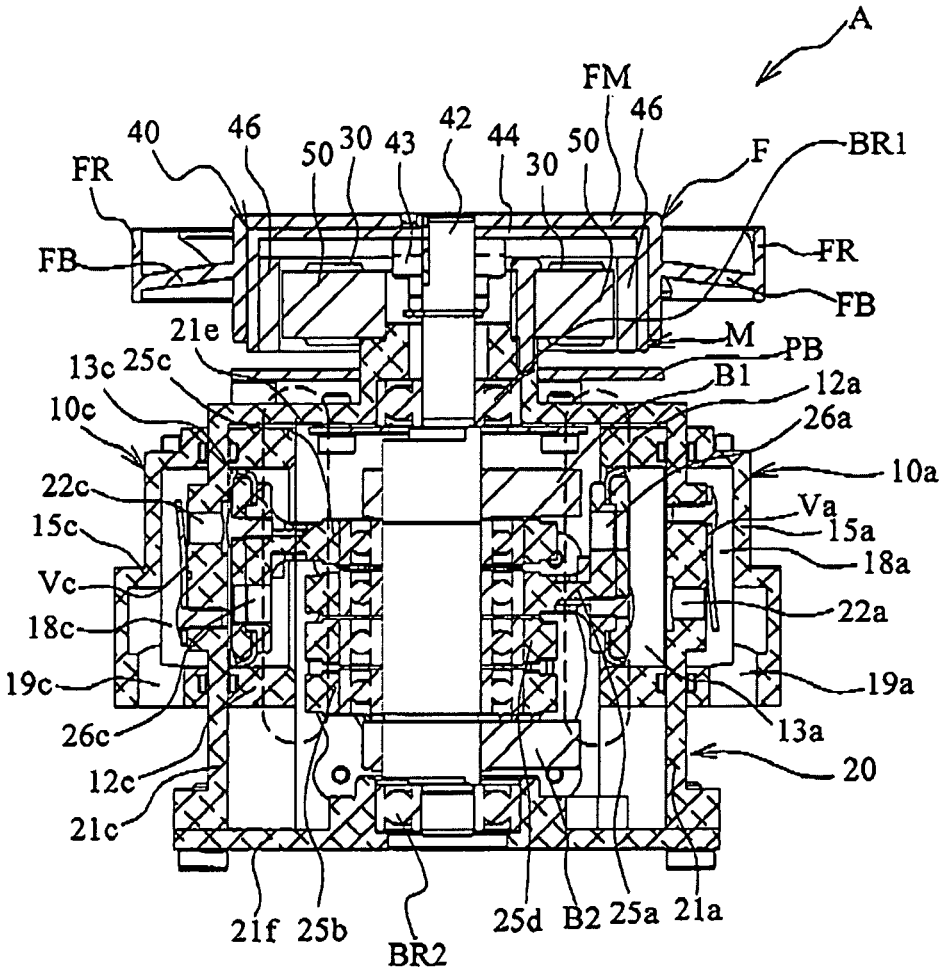
FIG. 3 is a sectional view taken along A-A line of FIG. 1.

FIG. 3 is a sectional view taken along line A-A of FIG. 1. Firstly, the motor M will be described. The motor M includes: coils 30, a rotor 40, a stator 50, and a printed circuit board PB. The stator 50 is made of metal. The stator 50 is secured to the crankcase 20. The plural coils 30 are wound around the stator 50. The coils 30 are electrically connected with the printed circuit board PB. As for the printed circuit board PB, conductive patterns are formed on an insulating board having rigidity. A non-illustrated power supply connector for supplying power to the coils 30, a signal connector, and other electronic parts are mounted on the printed circuit board PB. For example, the electronic part is an output transistor (a switching element) such as an FET for controlling an energized state of the coils 30, or a capacitor. The coils 30 are energized, so the stator 50 is energized.

The rotor 40 includes: a rotational shaft 42; a yoke 44; and one or plural permanent magnets 46. The rotational shaft 42 is rotationally supported by plural bearings BR1 and BR2 arranged within the crankcase 20. The yoke 44 is secured to the rotational shaft 42 through a hub 43, so the yoke 44 rotates together with the rotational shaft 42. The yoke 44 has a substantially cylindrical shape and is made of metal. One or plural permanent magnets 46 are secured to the inner circumferential side of the yoke 44. The permanent magnets 46 face the outer circumferential surface of the stator 50. The coils 30 are energized, so the stator 50 is energized. Thus, the magnetic attractive force and the magnetic repulsive force are generated between the permanent magnets 46 and the stator 50. This magnetic force allows the rotor 40 to rotate with respect to the stator 50. As mentioned above, the motor M is an outer rotor type motor in which the rotor 40 rotates.

A body portion FM of the fan F is secured to the yoke 44. Specifically, the body portion FM of the fan F is secured to the yoke 44 by press-fitting or engaging, but the secured manner is not limited to this. The body portion FM is provided with plural holes FH to reduce the weight thereof. Also, the yoke 44 is provided with holes H. The fan F is secured to the yoke 44 such that the holes H of the yoke 44 overlap the several holes FH of the fan F. This permits air to flow into the motor M through the holes H and FH. This can promote the heat radiation of the inside of the motor M, for example, the heat radiation of the coils 30. Also, the air which has flowed into the motor M through the holes H and FH partially flows toward the cylinder heads 15*a* to 15*d* and the crankcase 20 through clearances between the stator 50 and the permanent magnet 46. It is therefore possible to cool the compressor A which is heated by the sliding of the pistons and adiabatic compression of air. Additionally, the stator 50 is partially exposed from the holes H, as illustrated in FIGS. 1 and 2.

Next, the internal structure of the crankcase 20 will be described. The rotational shaft 42 extends within the crankcase 20. The plural pistons 25*a* to 25*d* are connected to a part of the rotational shaft 42 within the crankcase 20. The proximal end of the piston 25*a* is connected to the position through a bearing at a position eccentric to the center position of the rotational shaft 42. The rotation of the rotational shaft 42 in the single direction permits the piston 25*a* to reciprocate. Likewise, the other cylinders 10*b* to 10*d* and the other pistons 25*b* to 25*d* respectively moving therewithin have the same structure. The positional phase difference between the four pistons 25*a* to 25*d* is 90 degrees. The crankcase 20 is provided with a lower wall portion 21*f* at a side opposite to the motor M.

Cylinder bodies 12*a* and 12*c* are enclosed within the crankcase and secured to the internal surfaces of the middle wall portions 21*a* and 21*c* of the crankcase 20, respectively. When the rotational shaft 42 rotates, the distal end of the piston 25*a* slides on the cylinder body 12*a*. Herein, a cylinder chamber 13*a* is defined by the distal end of the piston 25*a*, the cylinder body 12*a*, and the middle wall portion 21*a*of the crankcase 20. The capacity of the cylinder chamber 13*a* increases and decreases by the reciprocation of the piston 25*a*. Likewise, the other pistons and the other cylinder bodies are configured in the same manner.

As illustrated in FIG. 2, an air hole 24*c* is provided with the middle wall portion 21*c* of the crankcase 20. The reciprocation of the piston 25*a* permits air to be introduced into the crankcase 20 through the air hole 24*c*. The distal end of the piston 25*a* is provided with a communication hole 26*a*. The end surface of the distal end of the piston 25*a* is provided with a non-illustrated valve member for opening and closing the communication hole 26*a*. An exhaust chamber 18*a* is defined between the cylinder head 15*a* and the middle wall portion 21*a*. The cylinder chamber 13*a* and the exhaust chamber 18*a* are separated by the middle wall portion 21*a* formed with a communication hole 22*a* communicating the cylinder chamber 13*a* with the exhaust chamber 18*a*. The communication hole 22*a* is opened or closed by a valve member Va secured to the outer surface of the middle wall portion 21*a*. As can be seen in FIG. 3, the interior diameter of exhaust chamber 18*a* matches in size with the interior diameter of cylinder chamber 13*a*. Likewise, the other cylinder heads 15*b* to 15*d* and the wall portions 21*b* to 21*d* are configured in the same manner. As shown in FIGS. 2-3, the cylinder heads are smaller than the respective outer surfaces of the middle wall portion to which they are affixed.

The reciprocation of the piston 25*a* changes the capacity of the chamber 13*a*. In response to this, air is introduced to the chamber 13*a* through the communication hole 26*a* and is compressed within the chamber 13*a*. The compressed air is discharged into the exhaust chamber 18*e* through the communication hole 22*a*. An air hole 19*a* is provided with the exhaust chamber 18*a*. A tube is connected to such an air hole 19*a*.

Likewise, the other cylinders 10*b* to 10*d* have the same structure. Thus, air introduced into the crankcase 20 through the air holes formed therein is compressed by the reciprocation of the pistons 25*a* to 25*d*, and is discharged outside the crankcase 20. Additionally, as illustrated in FIG. 3, balancers B1 and B2 are connected to the rotational shaft 42 within the crankcase 20.

As illustrated in FIG. 3, the cylinder body 12*a* is arranged within the crankcase 20, and the wall portion 21*a* of the crankcase 20 functions as a seating portion where that piston 25*a* is seated. Likewise, the other wall portions 21*b* to 21*d* function as seating portions on which the pistons 25*b* to 25*d* are seated, respectively. Additionally, in order to avoid collision noise in seating the piston, a slight gap may be made so as not to seat the piston completely. Thus, the compressor A is reduced in size in such a direction that the pistons 25*a* to 25*d* reciprocate, that is, in the direction perpendicular to the rotational shaft 42. This will be described below.

Figure 4:
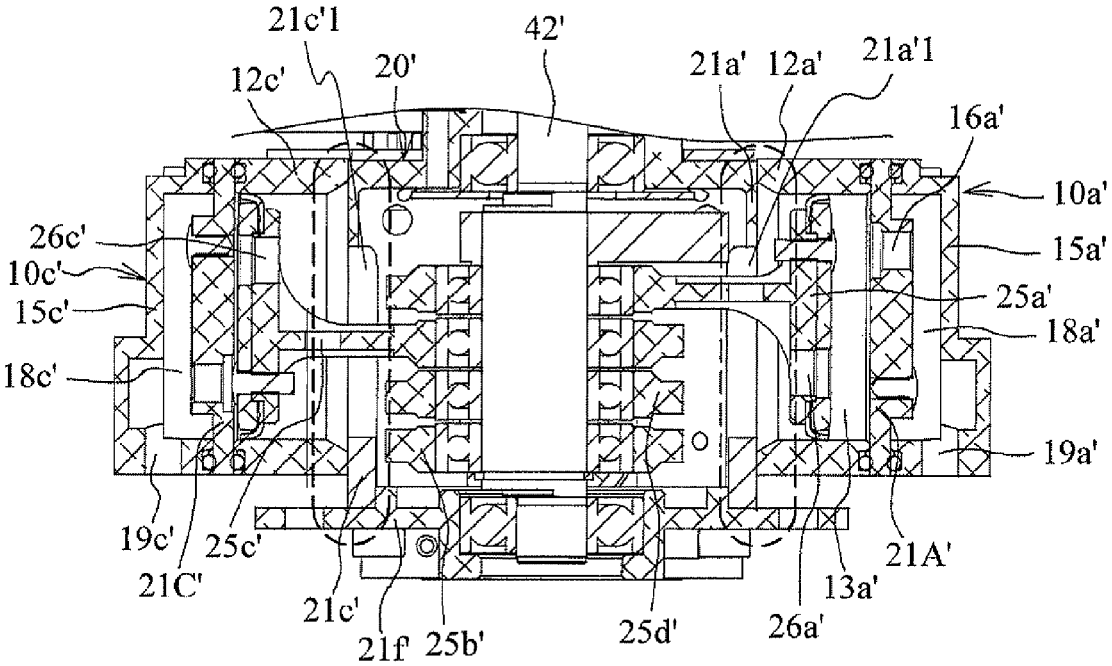
FIG. 4 is a sectional view of a part of a compressor different from the present embodiment.

FIG. 4 is a explanatory view of an example of a compressor A' having the structure different from the compressor A according to the present embodiment. Additionally, in the compressor A', similar components of the compressor A according to the first embodiment are designated with similar reference numerals and a description of those components will be omitted. Also, FIG. 4 is a partially sectional view of the compressor A'. As illustrated in FIG. 4, as for the compressor A', a cylinder body 12*a*' is secured to an outer surface of a wall portions 21*a*' of a crankcase 20'. Also, a cylinder head 15*a*' is secured to the cylinder body 12*a*'. A partition member 21A' is provided between a chamber 13*a*' defined in the cylinder body 12*a*' side and an exhaust chamber 18*a*' defined in the cylinder head 15*a*' side. The partition member 21A' functions as a seating portion where the distal end of a piston 25*a*' is seated. Thus, the wall portions 21*a*' of the crankcase 20' and the partition member 21A' are arranged in the direction perpendicular to a rotational shaft 42'.

Also, a wall portions 21*c*' and a partition member 21C' are arranged in the same manner. The other wall portion and the other partition member are arranged in the same manner. For this reason, the compressor A' is increased in size in the direction perpendicular to the rotational shaft 42'.

However, in the present embodiment, the wall portions 21*a* to 21*d* of the crankcase 20 functions as the seating portions for the pistons 25*a* to 25*d*, respectively. Thus, the compressor A according to the present embodiment does not need the partition member 21A'. Thus, in the compressor A according to the present embodiment, the size is reduced in such directions that the pistons 25*a* to 25*d* reciprocate, and the number of the parts is reduced.

Also, in the compressor A' illustrated in FIG. 4, the wall portions 21*a*' and 21*c*' of the crankcase 20' are formed with cutout portions 21*a*'l and 21*c*'I having the size to escape axes of the pistons 25*a*' and 25*c*', respectively. Also, the other wall portions have cutout portions in the same manner. On the other hand, in the compressor A according to the present embodiment, although the wall portion 21*a* of the crankcase 20 is provided with the communication hole 22*a*, the wall portion 21*a* is not provided with such a large cutout portion 21*a*'1 formed in the wall portion 21*a*' of the compressor A'. Therefore, the hardness of the crankcase 20 is greater than that of the crankcase 20'. Thus, the durability of the crankcase 20 is improved. Also, the crankcase 20 has high hardness, so it is easy to process the crankcase 20.

In the compressor A', the above mentioned cutout portion 21*a*'1 is provided in the wall portion 21*a*' of the crankcase 20', and the cylinder body 12*a*' is secured to the outer surface of the wall portion 21*a*'. Therefore, air might leak from a gap between the wall portion 21*a*' and the cylinder body 12*a*', so that drive noise might occur. In the present embodiment, such a large cutout portion is not provided in the crankcase 20. It is thus possible to prevent air from leaking from the crankcase 20 and to prevent the drive noise from occurring. Also, it is conceivable that a sealing member such as a rubber member is arranged so as to cover the gap in order to prevent air from leaking therefrom. However, such a sealing member is arranged, so that the number of the parts is increased. In the crankcase 20 according to the present embodiment, there are few points where air might leak, as compared with the crankcase 20'. Thus, the number of such seal members for preventing air from leaking is reduced.

Also, the motor M is the outer rotor type motor. The outer rotor type motor tends to have a torque higher than that of an inner rotor type motor, providing that they have the same size. In other words, if the outer rotor type motor has the same output as an inner rotor type motor, the outer rotor type motor can be made smaller. Thus, the motor M of the compressor A according to the present embodiment is made small.

Also, the fan F is secured to the yoke 44 of the motor M. The compressor A is reduced in size in the axial direction of the rotational shaft 42, for example, as compared with a case where the fan is arranged such that the fan and the motor M sandwich the crankcase 20.

Additionally, in the compressor A according to the present embodiment, air discharged from each of the cylinder heads 15*a* to 15*d* are combined by a tube or a pipe. That is, the crankcase 20 is not provided with a flow path for combining air discharged from each of the cylinder heads 15*a* to 15*d*. Thus, it is easy to manufacture the crankcase 20, and the crankcase 20 is reduced in size and weight, as compared with a case where the crankcase is provided with the flow path.

The Fan F is made of synthetic resin. The Yoke 44 where the fan F is secured is made of metal. The attenuation rate of the vibration of the fan F is greater than that of the rotor 40. It is therefore possible to reduce the drive noise of the compressor A. Further, the ring portion FR is provided at the ends of the plural blades FB to prevent an operator from touching the ends of the blades FB and getting injured. Also, it is preferable that the diameter of the fan F should be bigger than the surface of the compressor perpendicular to the rotational shaft 42.

As mentioned above, the compressor A is reduced in size, since the cylinder body 12*a* is secured to the internal surface of the wall portion 21*a* of the crankcase 20, the cylinder head 15*a* is secured to the outer surface of the wall portion 21*a*, the crankcase 20 is not provided with the flow path for communicating the plural cylinder heads 15*a* and 15*b* with each other, the outer rotor type motor M is employed, and the fan F is secured to the yoke 44 of the motor M.

Also, in the compressor A, the drive noise is reduced, since the wall portions 21*a* to 21*d* of the crankcase 20 are not provided with a large cutout portion, and the attenuation rate of the fan F is greater than that of the rotor 40.

Additionally, when the object device is connected at the intake side of the compressor A or when a check valve is arranged in a manner opposite to a manner of the compressor A, the compressor A acts as a vacuum machine.

Also, in another case where the compressor A is used as a vacuum machine, the object device is connected to the air hole 24*c*. In this case, the valve member provided within the cylinder 10*a* may be the same as the compressor A.

While the exemplary embodiments of the present invention have been illustrated in detail, the present invention is not limited to the above-mentioned embodiments, and other embodiments, variations and modifications may be made without departing from the scope of the present invention.

The above embodiment is an example of the configuration where four pairs of the cylinder and the piston are provided. However, the present invention is not limited to this configuration. For example, one, two, or three pairs of the cylinder and the piston may be provided. More than four pairs of the cylinder and the piston may be provided.

What is claimed is:

1. A compressor comprising:

a motor;

a piston reciprocating by the motor;

a crankcase including a middle wall portion having a first communication hole, and the crankcase housing the piston;

a printed circuit board arranged between the crankcase and the motor;

a cylinder body enclosed within the crankcase and secured to an inner surface of the middle wall portion, the cylinder body and the middle wall portion defining a cylinder chamber having a diameter, and reciprocation of the piston increasing or decreasing a capacity of the cylinder chamber; and a cylinder head secured to an outer surface of the middle wall portion, and the cylinder head and the middle wall portion defining an exhaust chamber having a diameter, the exhaust chamber communicating with the cylinder chamber through the first communication hole, wherein:

the outer surface of the middle wall portion to which the cylinder head is secured is flat, the cylinder head being smaller than the outer surface, the exhaust chamber diameter matching in size with the diameter of the cylinder chamber, the crankcase includes an upper wall portion and a lower wall portion, the upper wall portion and the lower wall portion respectively holding first and second bearings, the crankcase has a rectangular shape when viewed in an axial direction of the motor, the upper middle wall portion and the wall portion are integrally formed with each other, and the motor is an outer rotor type motor arranged outside of the crankcase.

2. The compressor of claim 1, wherein an outer rotor of the motor is provided with a fan.

3. The compressor of claim 2, wherein the fan is radially arranged about the outer rotor.

4. The compressor of claim 2, wherein the fan is secured to a yoke of the outer rotor, and each of the fan and the yoke is provided with a hole permitting air to flow from the outside of the motor to the inside of the motor.

5. The compressor of claim 2, wherein the fan has a ring-shaped outer circumference.

6. The compressor of claim 1, wherein a distal end of the piston includes a second communication hole that introduces fluid into the cylinder chamber.

7. A vacuum machine comprising:

a motor;

a piston reciprocating by the motor;

a crankcase including a middle wall portion having a first communication hole, and the crankcase housing the piston;

a printed circuit board arranged between the crankcase and the motor;

a cylinder body enclosed within the crankcase and secured to an inner surface of the middle wall portion, the cylinder body and the middle wall portion defining a cylinder chamber having a diameter, and reciprocation of the piston increasing or decreasing a capacity of the cylinder chamber; and a cylinder head secured to an outer surface of the middle wall portion, and the cylinder head and the middle wall portion defining an exhaust chamber having a diameter, the exhaust chamber communicating with the cylinder chamber through the first communication hole, wherein:

the outer surface of the middle wall portion to which the cylinder head is secured being flat, the cylinder head being smaller than the outer surface, the exhaust chamber diameter matching in size with the diameter of the cylinder chamber, the crankcase includes an upper wall portion and a lower wall portion, the upper wall portion and the lower wall portion respectively holding first and second bearings, the crankcase has a rectangular shape when viewed in an axial direction of the motor, the upper middle wall portion and the wall portion are integrally formed with each other, and the motor is an outer rotor type motor arranged outside of the crankcase.

8. The vacuum machine of claim 7, wherein an outer rotor of the motor is provided with a fan.

9. The vacuum machine of claim 8, wherein the fan is radially arranged about the outer rotor.

10. The vacuum machine of claim 8, wherein the fan is secured to a yoke of the outer rotor, and each of the fan and the yoke is provided with a hole permitting air to flow from the outside of the motor to the inside of the motor.

11. The vacuum machine of claim 8, wherein the fan has a ring-shaped outer circumference.

12. The vacuum machine of claim 7, wherein a distal end of the piston includes a second communication hole that introduces fluid into the cylinder chamber.

* * * * *